United States Patent [19]

Cole

[11] Patent Number: 4,810,122

[45] Date of Patent: Mar. 7, 1989

[54] COSMETIC APPLICATOR AND WIPER THEREFORE

[76] Inventor: Rodney D. Cole, 24 Pine Walk, Cobham, Surrey, England

[21] Appl. No.: 865,080

[22] Filed: May 19, 1986

[30] Foreign Application Priority Data

May 21, 1985 [GB] United Kingdom ..... 8512801

[51] Int. Cl.[4] ..... A46B 11/00

[52] U.S. Cl. ..... 401/122; 132/218

[58] Field of Search ..... 401/121, 122, 126, 127, 401/129, 130, 132; 132/85

[56] References Cited

U.S. PATENT DOCUMENTS 3,930,280 6/1976 Vasas ..... 132/85 X
4,470,425 9/1984 Gueret ..... 401/122 X
4,628,950 12/1986 Bitzer ..... 401/122 X

FOREIGN PATENT DOCUMENTS 230295 4/1910 Fed. Rep. of Germany ..... 401/122
430437 12/1911 France ..... 401/122
10237 of 1914 United Kingdom ..... 401/122

*Primary Examiner*—Dave W. Arola
*Attorney, Agent, or Firm*—Lerner, David, Littenberg, Krumholz & Mentlik

[57] ABSTRACT

A cosmetic container and applicator assembly is provided wherein the applicator head and a wiper within the container both have non-circular configurations such that the wiping effect achieved by the wiper can be varied by altering the rotational position of the applicator relative to the wiper.

18 Claims, 3 Drawing Sheets

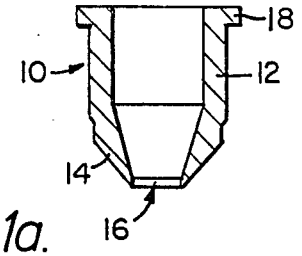
FIG. 1a.
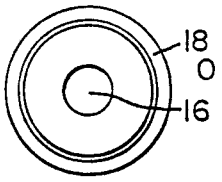
FIG. 1b.
FIG. 2.
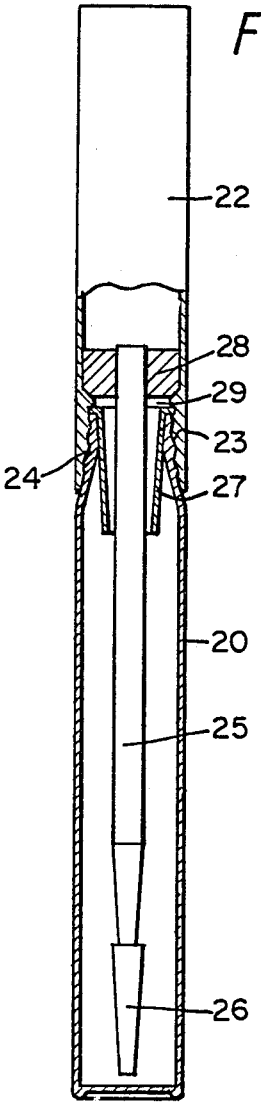
FIG. 3a.
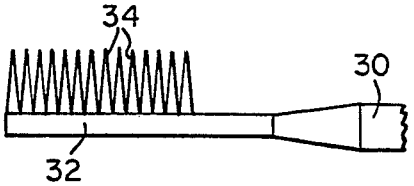
FIG. 3b.
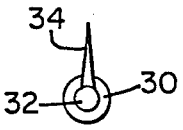

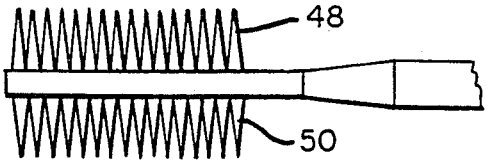
FIG. 9.
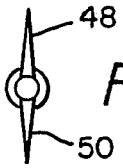
FIG. 10.
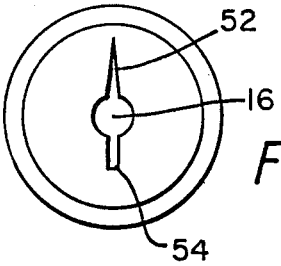
FIG. 11.
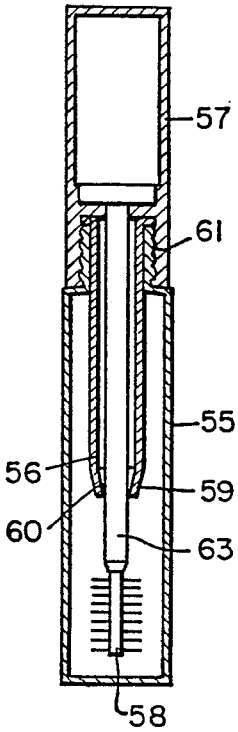
FIG. 12.
FIG. 13.
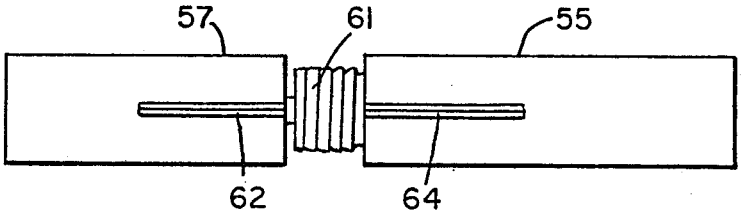

COSMETIC APPLICATOR AND WIPER THEREFORE

BACKGROUND OF THE INVENTION

This invention relates to a cosmetic applicator of the type used for applying cosmetic materials to the face, and to a container for such materials which is fitted with a wiper for the applicator.

DESCRIPTION OF THE PRIOR ART

Cosmetics such as mascara are commonly sold in containers with an applicator projecting into the container and secured to the underside of the container cap. Radial projections such as bristles or teeth are provided on the applicator to hold cosmetic material thereon, and a wiper for the applicator is supported by the mouth of the container. The wiper generally comprises a constriction of flexible plastics material or the like, the relative sizes of the applicator and the constriction being such that as the applicator is withdrawn from the container a portion of the material is wiped from it. A typical example of such an assembly is disclosed in GB-A-2097662.

According to one aspect of the present invention there is provided a cosmetic container and applicator assembly comprising:

a container for cosmetic material having an opening and a wiper in or aligned with said opening, the wiper presenting a non-circular aperture at least part of which is smaller in cross-section than the opening of the container; and an applicator comprising a shaft with a longitudinally extending row of radial projections for holding cosmetic material, the applicator being adapted for insertion into the container so that at least the part on which said projections are formed passes through said aperture of the wiper, said aperture including a radial slot with which said row of projections can be made to register as the applicator is withdrawn from and inserted into the container through said aperture in a "key" and "keyhole" fashion.

There may be a single said row of projections e.g. bristles, bristle tufts, or teeth and a corresponding single slot, the aperture acting as a "keyhole" for the insertion and withdrawal of the applicator into and from the container. The slot may be shaped and dimensioned to provide a certain wiping action on the row of projections.

This aspect of the invention has the advantage of providing an applicator of the specified type, i.e. one having a row of lateral, or side projections, which is preferred for certain cosmetic application purposes, in an assembly with a container into which the applicator can project when it is not being used, wiping of the shaft being facilitated without impeding the passage of the row of projections through the wiper.

According to another aspect of the present invention there is provided an assembly of an applicator and a container for the material to be applied by the applicator, a wiper being provided on the container in such a way that different degrees of wiping efficiency may be achieved by selecting the angular orientation between the wiper and the applicator when removing the applicator from the container.

An advantage of the applicator and wiper assembly of this aspect of the invention is that the amount of liquid left on the applicator when it is withdrawn from the container through the wiper can be varied as desired, which is not possible in the known assembly in view of the generally uniform patterns of the projections on the applicator and of the wiper.

According to a further aspect of the present invention there is provided a cosmetic container and applicator assembly comprising:

a container for cosmetic material having an opening and a wiper in or aligned with said opening, the wiper presenting a non-circular aperture at least part of which is smaller in cross-section than the opening of the container; and an applicator comprising a shaft with radially extending projections to hold cosmetic material, the applicator being adapted for insertion into the container so that at least the part on which said projections are formed passes through said aperture of the wiper, the size and circumferential distribution of said projections being such that the amount of material wiped from the applicator as it is withdrawn from the container can be varied by rotation of the applicator about its axis relative to the wiper.

In these latter two aspects of the invention, the projections on the applicator are preferably arranged in one or more longitudinal rows which can, by rotation of the applicator relative to the wiper, be brought into or out of register with corresponding slots in the wiper. The degree to which the rows of projections on the applicator register with slots in the wiper will determine the efficiency of wiping, that is to say the amount of material wiped off the projections, and thus controls the residue of material remaining on the applicator after its withdrawal from the container.

The projections are preferably integrally molded onto the applicator, and may comprise flexible bristles or rigid teeth. The wiper is preferably resiliently deformable. The applicator and the wiper can both be made by injection molding.

The applicator is preferably secured to the inside of a cap for the container so that when the cap is fitted the applicator projects into the container through the wiper. To assist in obtaining the desired rotational alignment of the applicator and the wiper, markings may be provided on the outside of the container and of its cap. These markings may be designed as a scale indicating to the user the variation in the quantity of material which will be retained on the applicator when withdrawn at the various different rotational positions relative to the container.

Preferred embodiments of the invention will now be described by way of example with reference to the accompanying drawings.

BRIEF DESCRIPTION OF THE DRAWINGS

FIG. 1 (*a* and *b*) shows respectively a vertical cross-section and a bottom plan view of a conventional wiper having a circular central aperture;

FIG. 2 is a part sectional elevation of a conventional applicator with an alternative form of wiper;

FIG. 3 (*a* and *b*) shows respectively a partial side view and an end elevation of an applicator suitable for use in the present invention;

FIG. 9 is a side view of a third embodiment of an applicator for use of the present invention;

FIG. 10 is an end view of the applicator shown in FIG. 9;

FIG. 11 is a plan view of a wiper suitable for use in conjunction with the applicator of FIGS. 9 and 10;

FIG. 12 is a sectional view of an applicator and wiper assembly in accordance with the present invention; and FIG. 13 is an external side view of the assembly of FIG. 12 showing the markings to indicate the relative rotational positions of the applicator and wiper.

Figure 4A:
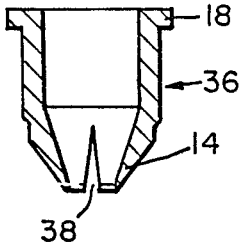
FIG. 4 (*a* and *b*) shows respectively a vertical cross-section and a top plan view of a wiper in accordance with the present invention suitable for use in conjunction with the applicator of FIG. 3.

Referring first to FIG. 1, a conventional wiper (10) made of a resilient plastics material comprises a cylindrical main portion (12) with a conically tapered portion (14) at its lower end and a central aperture (16) through the wiper the lower end of which forms the wiping surface. The wiper has at its upper end an annular flange (18) to bear against an outer edge of a container for cosmetic liquid so that the wiper can fit into the neck of the container with a friction fit.

Because the aperture (16) is circular, the effect of the wiper on any given applicator will be the same irrespective of the rotational position of the applicator relative to the wiper.

FIG. 2 shows a typical conventional applicator and wiper assembly. A container (20) for a viscous liquid or semi-liquid (e.g. paste-like) cosmetic material has a cap (22) with an internal thread (24) to engage the externally threaded neck (23) of the container.

The neck (23) of the container is tapered slightly inwards and receives a wiper (27) by means of a friction fit. This wiper is somewhat longer than the wiper shown in FIG. 1 and is of uniform frustoconical shape, but its function is essentially the same as that of FIG. 1.

An applicator with a shaft (25), a head (26) and an annular flange (29) at its upper end is firmly held by a molded portion (28) in the container cap (22).

The head (26) of the applicator is provided with bristles, for example as shown in GB-A-2097662. When the applicator is withdrawn from the container by unscrewing the cap (22) and pulling it upwards, the head (26) of the applicator brings with it a quantity of the liquid, some of which is wiped off by the lower edge of the wiper (27). As has been explained above, the effect of this wiping will be the same irrespective of the rotational position of the applicator, because the wiper (27) is of circular cross-section throughout.

FIG. 3 shows one end of an applicator suitable for use with the present invention. This shows one end of an injection molded shaft (30) with a narrowed head portion (32) and a row of integrally molded bristles (34). This arrangement is shown in side view in FIG. 3A and in end elevation in FIG. 3B.

Figure 4B:
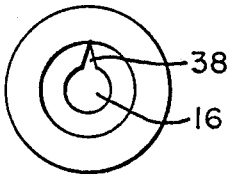

In accordance with the invention, the applicator of FIG. 3A can be used in conjunction with a wiper (36) as shown in FIG. 4. This is similar to the wiper of FIG. 1 except that a slot (38) is provided extending axially and radially from the edge of the wiper aperture (16). It can be seen that if the bristles (34) of the applicator of FIG. 3 are aligned with the slot (38) when the applicator is withdrawn through the wiper (36), the manner in which they will be wiped will be different than if the applicator is withdrawn from any other rotational position and wiped against the circular edge of the aperture (16). For example, in the former case the applicator will pass almost unhindered through the wiper if the slots (38) are made relatively wide, so that only a relatively small amount of material will be wiped from the bristles, whereas in the latter case the relatively flexible bristles will encounter the relatively stiffer edge of the wiper aperture at a position close to their roots and will have to deform substantially in order to pass through the aperture, so that they will be more strongly wiped. It will be understood that in this and later embodiments, a different variation in wiping action between the bristle/slot alignment and non-alignment positions can be obtained by employing different size relationships between the slots and the bristles.

Figure 6:
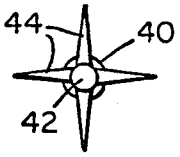
FIG. 6 shows an end view of the applicator of FIG. 5.
Figure 5:
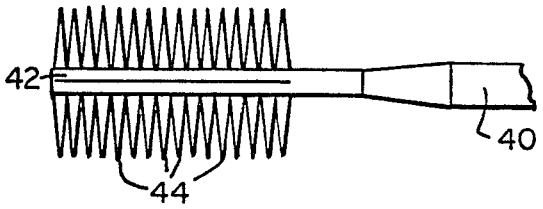
FIG. 5 shows a side view of a second embodiment of an applicator suitable for the present invention.

The applicator head shown in FIGS. 5 and 6 is similar to that of FIG. 3, comprising a shaft (40) with a narrowed end portion (42), but with four longitudinal rows of bristles (44) extending radially from the narrowed end portion of the shaft and spaced at intervals of 90°.

Figure 7:
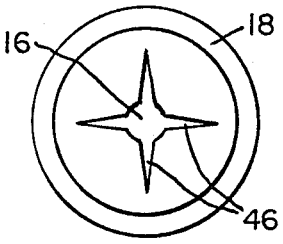
FIG. 7 shows in plan view a wiper suitable for use in conjunction with the applicator of FIGS. 5 and 6.

The applicator of FIGS. 5 and 6 can be used in conjunction with a wiper as shown in FIG. 7, which has four radial slots (46) at 90° intervals with which the four rows of bristles (44) of the applicator can be aligned. In the aligned position, the bristles in all four rows are wiped as they are drawn through the slots (46), whereas if the applicator is rotated out of alignment, for example through 45°, all four rows of bristles will be wiped in a different fashion by the edges of the aperture (16) between the radial slots (46).

Figure 8:
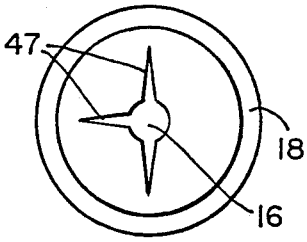
FIG. 8 shows in plan view an alternative form of wiper also suitable for use with the applicator of FIGS. 5 and 6.

An alternative wiper is shown in FIG. 8 in which only three radial slots (47) are provided, again spaced at 90° intervals. If this wiper is used in conjunction with the applicator of FIG. 6, it can be seen that one of the rows of bristles (44) will always receive a wipe by the inner edge of aperture (16) even when the other three rows of bristles are aligned with and wiped differently by the radial slots (47). When withdrawn in a rotational position in which all of the bristle rows are out of alignment with the slots, the wiping effect is the same as in the non-aligned position using the FIG. 7 wiper.

FIGS. 9 and 10 show in side view and end elevation a further applicator suitable for use in the present invention which comprises two rows (48), (50) of similarly shaped flexible bristles. It can be seen that even when the applicator is not wiped at all these two rows or projections will carry different amounts of material, the bristles in the row (48) being less numerous and more widely spaced than the bristles in the row (50).

The applicator of FIGS. 9 and 10 can be used in conjunction with the wiper shown in FIG. 11 which has aligned slots (52 and 54), spaced at 180° around the central aperture (16), correspondingly with the spacing of the bristle rows (48), (50). When the applicator is disposed with the bristles (48) aligned with the slot (52) and the bristles (50) aligned with the slot (54), the rows of projections will be wiped by the respective slots. If the applicator is rotated through 180°, the wiping action will change as the bristles (50) will be wiped by the slot (52) whereas the bristles (48) will be wiped by the slot (54). If the applicator is rotated to an intermediate position with the projections (48), (50) transverse to the slots (52, 54) another different wiping action will be obtained as both sets of projections will be wiped by the inner edge of the aperture (16).

Referring finally to FIGS. 12 and 13, a container (55) for cosmetic liquid has a narrowed neck portion (61) with an external thread which fits an internal thread on cap (57). The arrangement is thus broadly similar to that of FIG. 2

The wiper (56) is however much longer than in the container of FIG. 2, comprising a long cylindrical portion with a frustoconical portion (60) which is positioned approximately half way towards the bottom of the container. This portion is provided with one or more radial slots (59), in any desired pattern as discussed above.

The applicator in this arrangement has a shaft (63) and a head (58) which may have any of the configurations discussed above in relation to FIGS. 3 to 10 or any other configuration which will give the desired effect in accordance with the invention.

The thread fitting of the cap to the container is such that when the cap is unscrewed up to the top of the thread as shown in FIG. 13 the head (58) of the applicator is brought right up to a position immediately below the frustoconical end portion (60) of the wiper. The applicator is then rotated to the correct angular position to give the desired wiping effect.

As shown in FIG. 13, external markings (62 and 64) provided respectively on the cap and on the container are used to indicate the rotational position of the applicator head relative to the wiper. For example, the arrangement might be such that when the two markings are axially aligned each row of projections on the applicator is aligned with a corresponding slot, as for example in FIGS. 10 and 11. Other relative rotational positions of these two markings will then indicate other alignments of the projections on the applicator head and the slots on the wiper to give different wiping effects.

In all of the above-described embodiments, the longitudinal part-cylindrical land surface portions of these applicator heads, e.g. the four land surface portions of arcuate quadrant section between the four rows of bristles in the applicator of FIG. 5, are wiped of the cosmetic material by the arcuate portions of the wiper aperture 16 to a degree which varies according to the relative rotational position of the applicator and wiper. For example, when the FIG. 5 applicator is withdrawn through the FIG. 7 wiper with the bristle rows aligned with the slots 46, these longitudinal surface portions are wiped substantially clean. Withdrawal with the bristle rows of alignment with the slots will cause the slots to leave stripes of the material extending along these surface portions.

The sizes and shapes of the projections on the applicator head and of the slots of the wiper can be engineered to predetermined tolerances to give a desired amount of material on the wiped applicator for each rotational position of the applicator.

Other configurations of projections and wipers are of course envisaged, and although combinations in which the applicator has substantially the same configuration in plan view as the wiper are preferred, other configurations can be considered for particular purposes.

Numerous other embodiments of the invention are also envisaged. For example, the wiper could have a flat base rather than a conical one and may have any suitable non-circular shape, for example eliptical. Conventional filled bristles could be used instead of the integrally molded bristles or rigid comb-teeth described. The rows of bristles, or the applicator surface, need not be in a straight line but could instead be curved.

As regards the means for indicating the relative rotational positions of the applicator and the wiper, means other than exterior markings can also be considered. For example, the container and/or the cap could be of non-circular shape. The lower edge of the cap or the upper shoulder of the container could be at an oblique angle rather than straight. If a push on cap is used rather than a threaded one a stem with a non-circular cross-section such as oblong or eliptical used in conjunction with a corresponding wiper aperture would give the required alignment.

In the described embodiments the variation in wiping action has been obtained by rotating the applicator relative to the container, the wiper being fixed in the container. An alternative to this arrangement, capable of producing an equivalent affect, would be to arrange for the wiper to be adjustably rotatable in the container. To achieve the variable wiping action, the applicator would need to be withdrawn always in the same rotational position relative to the container, and this could be ensured by suitable adaption of the means of attachment of the container cap, from which the applicator projects, to the container neck.

Quite apart from their ability to provide variation of the degree of wiping of the applicator on withdrawal from the container, the above specifically described arrangements possess preferred structural features in that they each have one or a small number (maximum of four in the disclosed assemblies) of longitudinal rows of side projections, e.g. teeth or bristles, provided on an applicator which forms part of an applicator/container cosmetics assembly in which the applicator, or at least that part of it having such projections, can conveniently be accommodated within the container when not being used. Moreover, due to the provision of the slot or slots in the wiper orifice affording a "keyhole" type access into and from the container, the shaft on which the projections are provided, and optionally also the projections themselves, can be wiped without impeding the passage of the applicator into and out of the container.

In the described embodiments, the projections in the or each row on the applicator extend laterally equidistantly from the axis of the applicator shaft. By this arrangement all of the projections in a given row will receive a similar wipe on withdrawal of the applicator, whether it be from the edge of the central aperture or of a slot extending radially therefrom. Also, the opening of the wiper has a central aperture (16) which provides one or more (dependent upon the number of radial slots) arcuate wiper edge portions against which the bristles of any row which is not aligned in a slot can be wiped.

I claim:

1. A cosmetic container and applicator assembly comprising:

a container for cosmetic material having a container opening between the inside and outside thereof, a wiper in or aligned with said container opening, the wiper having a non-circular wiper aperture at least part of which is smaller in cross-section than said container opening, no portion of said container opening between said wiper aperture and the outside of the container having a cross-section as small as the cross-section of said wiper aperture; and an applicator comprising a shaft with radially extending projections to hold cosmetic material, the applicator being adapted for insertion into the container through said container opening so that at least the part on which said projections are formed passes through said wiper aperture, the size and circumferential distribution of said projections being such that the amount of material wiped from the applicator as it is withdrawn from the container can be varied by rotation of the applicator about its axis relative to the wiper.

2. An assembly according to claim 1 wherein the applicator has at least one longitudinal row of said projections.

3. An assembly according to claim 2 wherein the applicator has first and second said rows of projections, the projections of said first row being longer than the projections of said second said row.

4. An assembly according to claim 2 wherein said projections include a longitudinal row of flexible bristles.

5. An assembly according to claim 4 wherein said bristles are integrally molded with the shaft.

6. An assembly according to claim 1 wherein the wiper has a central aperture with at least one slot extending radially therefrom.

7. An assembly according to claim 6, wherein the shaft has a portion extending between the wiper and the projections when the applicator is fully inserted into the container and that portion of the wiper which forms the central aperture engages the shaft to wipe said portion of the shaft upon withdrawal of the applicator from the container.

8. An assembly according to claim 6 wherein the wiper has at least two said radial slots of different sizes.

9. An assembly according to claim 6 wherein the applicator has a plurality of circumferentially spaced axially extending rows of projections, and the wiper has a plurality of circumferentially spaced slots extending radially from said aperture, the spacing of the slots corresponding with the spacing of the rows of projections.

10. An assembly according to claim 9 wherein the number of rows of projections corresponds with the number of slots.

11. An assembly according to claim 9 wherein the projections and the radial slots are in register in only one rotational position of the applicator relative to the wiper.

12. An assembly according to claim 6 or claim 9 wherein said radial slot or slots is or are formed in a conical portion of the wiper.

13. An assembly according to claim 1 wherein the aperture in the wiper is located within the container, axially spaced from the container opening.

14. An assembly according to claim 1 wherein the wiper is resiliently deformable.

15. An assembly according to claim 1 wherein the applicator projects from the inside of a cap for the container, and extends into the container through the wiper when the cap is fitted to the container.

16. As assembly according to claim 15 wherein the cap and the container carry markings to indicate the rotational position of the applicator to the wiper.

17. An assembly according to claim 15 wherein the cap is fitted to the container by means of a screwthread.

18. An assembly according to claim 17 wherein the screwthread is such that the cap is released from the container at a position in which the radial projections on the applicator nearest the cap are immediately below the wiper aperture.

* * * * *

UNITED STATES PATENT AND TRADEMARK OFFICE

CERTIFICATE OF CORRECTION

PATENT NO. : 4,810,122

DATED : March 7, 1989

INVENTOR(S) : Rodney D. Cole

It is certified that error appears in the above-identified patent and that said Letters Patent is hereby corrected as shown below:

Column 4, line 51, "or" should read --of--.

Column 5, line 50, between "rows of" insert --out--.
Column 8, line 27, between "applicator to" insert --relative--.

Signed and Sealed this

Thirty-first Day of October, 1989

*Attest:*

DONALD J. QUIGG

*Attesting Officer*

*Commissioner of Patents and Trademarks*